US005743414A

United States Patent [19]

Baudino

[11] Patent Number: 5,743,414

[45] Date of Patent: Apr. 28, 1998

[54] BOARD EDGING SYSTEM AND METHOD OF MANUFACTURE THEREOF

[75] Inventor: Rodney Jay Baudino, Woodridge, Ill.

[73] Assignee: Sanford Corporation, Bellwood, Ill.

[21] Appl. No.: 596,571

[22] Filed: Feb. 5, 1996

[51] Int. Cl.[6] ..... A47F 5/00

[52] U.S. Cl. ..... 211/69.1; 211/94.01; 211/89.01; 248/316.7

[58] Field of Search ..... 211/69.1, 69.5, 211/162, 94.01, 86.01, 89.01, 60.1; 248/316.7, 316.8, 309.1

[56] References Cited

U.S. PATENT DOCUMENTS

| | | | |
|---|---|---|---|
| 1,979,773 | 11/1934 | Ritch | 211/69.1 |
| 2,802,250 | 8/1957 | Klotz | 248/316.7 X |
| 3,140,781 | 7/1964 | Rothgart | 211/86.01 X |
| 3,797,795 | 3/1974 | Hemgren | 248/316.7 |
| 3,807,675 | 4/1974 | Seckerson | 248/316.7 X |
| 4,067,536 | 1/1978 | McBeth | 248/316.7 |
| 5,232,103 | 8/1993 | Koenig et al. | 211/69.5 |

*Primary Examiner*—Robert W. Gibson, Jr.
*Attorney, Agent, or Firm*—Foley & Lardner

[57] ABSTRACT

A board edging system for cork, dry erase and other board consisting of an endless ring of rubber or rubber-like material which, when stretched to fit around the edges of a board, functions to hold the board together as a unit and, by reason of an internal channel, provides an anchor support for markers and other attachments along any edge of the board.

13 Claims, 2 Drawing Sheets

Fig. 1.
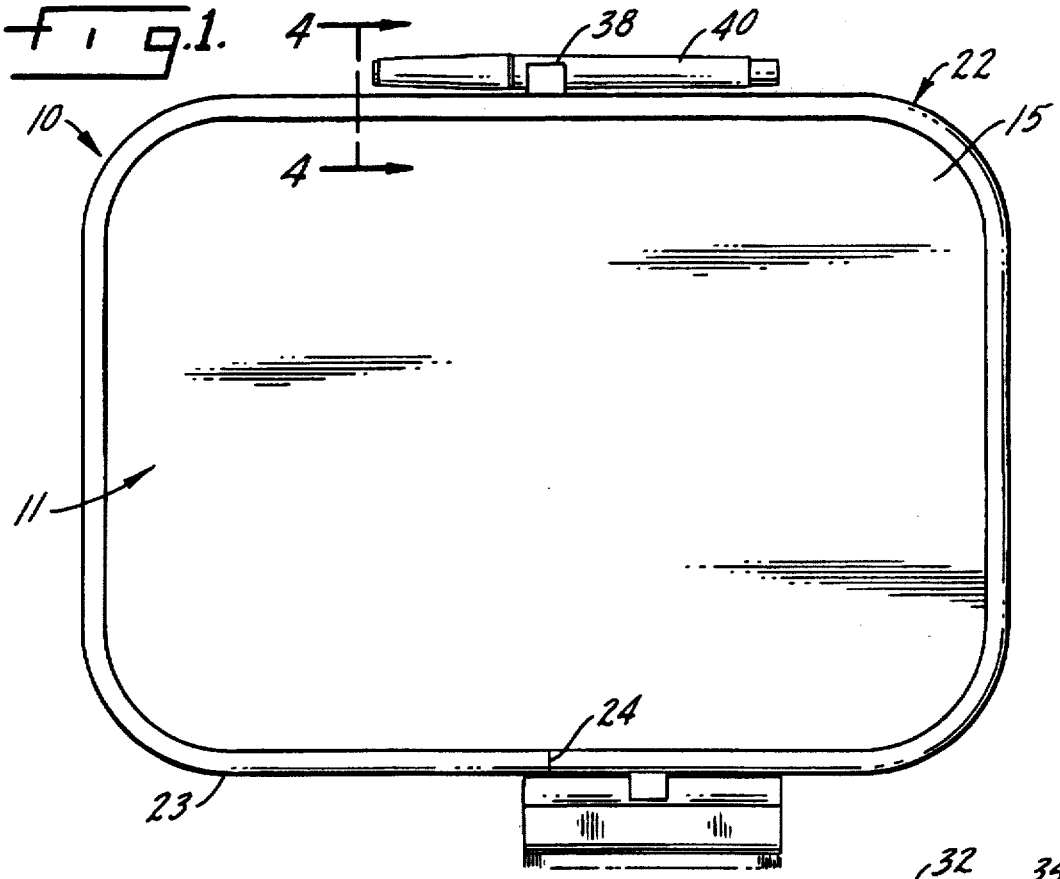
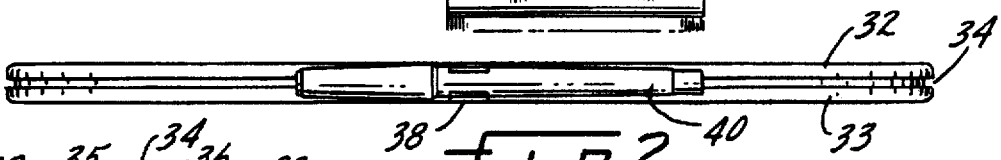
Fig. 2.
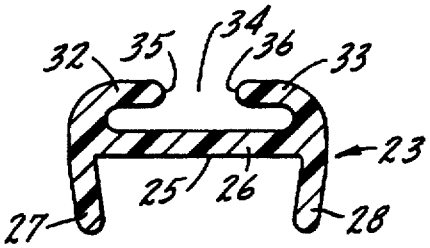
Fig. 3.
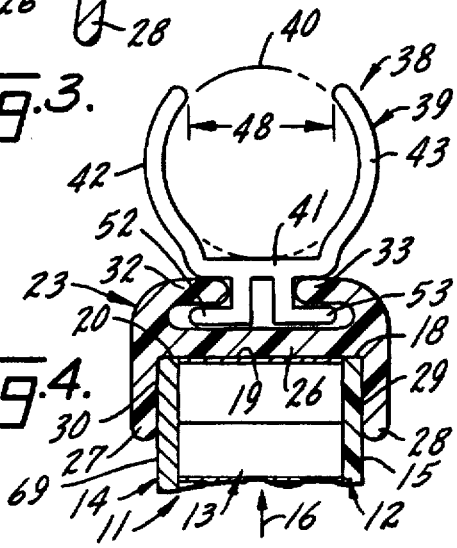
Fig. 4.
Fig. 5.
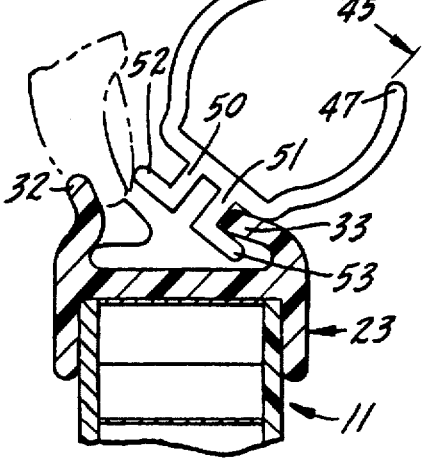

BOARD EDGING SYSTEM AND METHOD OF MANUFACTURE THEREOF

This invention relates generally to writing boards and particularly dry erase boards, cork bulletin boards, chalk boards and combinations thereof, and specifically to such a board having a unique edging system and a method of manufacture thereof.

BACKGROUND OF THE INVENTION

Writing boards, particularly boards of a size smaller than a conventional black board as found in a school room, have been known for many years. One popular form of such a board is known as a dry erase board, and for purposes of ease of description the invention will be described in terms of a dry erase board. Such a board typically has a thin, hard, front surface of plastic or other suitable material which is adhered to an internal support structure such as, for example, a honeycomb-like spacer made of Kraft-type paper or other suitable material, and a backing which covers the internal support structure. The backing may, for example, be merely a layer of Kraft-type paper or a cork surface, or even a thin, hard, plastic surface which is similar or identical to the front surface.

In view of the materials from which the board is constructed, and particularly the core material which may have great compressive strength but little resistance to lateral forces, an edging which protects the exposed edges of the several layers comprising the board is essential. Currently such edging may be a smooth or contoured wooden or plastic frame which has substantial inherent stiffness. Although usable, such edgings have significant disadvantages in that they are quite costly, both from a molding and assembly standpoint, they cannot (without substantial difficulty and expense) be adapted to rounded corners, they require supplemental part-to-part connecting means such as nails or other fasteners or an adhesive substance, and they are often prone to loosen all around the periphery of the board if one edge, due to rough usage, for example, comes loose, and particularly if the individual edging parts are held together by a friction interlock. A continuous edging has recently come into use, such edging being a defined length of a deformable material, such as soft vinyl, which is wrapped around a board and the abutting edges glued together. There are several drawbacks to this system however, including the cost inherent in fastening the ends to one another, and the tendency of the ends to separate, and render the system inoperative, as a result of environmental conditions.

Accordingly, a need exists for a flexible board edging which is economical to manufacture, easy to install, adaptable to all board configurations (sharp cornered, as well as round cornered, or even irregular shapes), and, once installed, will not easily disengage from the board, should perchance a break occur at one location in the edging after installation.

A further desirable feature of such boards is an ability to not only provide a protective buffer or edging to the edges of the board, but also to form a foundation for attachment to the board of utensils, such as markers, erasers, trays, and even board suspension or mounting means. It is highly desirable, for example, that a user of such a board have a marker available the instant a need arises to mark on the board. Since such markers are generally somewhat larger than a typical pen or pencil it is not convenient for the ordinary user to carry such a marker along with a pen or pencil. Hence a board must, as a practical matter, also have associated with it a marker which is available the moment the user wishes to use it. As a consequence the board, together with its edging, must have means for retaining markers and other tools in a readily accessible location at all times in addition to the above described advantages provided by the edging per se. In this regard, the edging and applicable tools or utensils taken together comprise a board edging system.

A related attribute which increases the usability of the board edging system, and therefore may be thought of as a component of the system, is suspension means for suspending the board from a plurality of locations, such as a typical vertical surface; i.e.: a wall of a room, or from the top of a vertical member, such as the top of the exposed upper edge of divider walls which are found in many offices today, said offices being formed from standard sized dividers arranged to make cubicles of varying sizes in a large, open room. Hence, in addition to the advantages above-described, the board edging system includes suspension means for suspending or supporting the board and its edging from vertical or top edge bases, said suspension means thereby also comprising a component in a board edging system in the sense that the suspension means makes contact with the edge portions of the board when it performs its suspending functions.

SUMMARY OF THE INVENTION

It is therefore an object of this invention to provide a board edging system, along with a method of manufacture thereof, which has the ability to perform, in various combinations of components, all of the above-described desirable functions in one form or another.

In a currently preferred form of the invention an edging, formed from a soft and resilient material having the characteristics with respect to deformability and resiliency of rubber or soft plastic, is provided in a ring-like endless form, said form consisting of a unique shape whose ends are melted together prior to installation to a board. If the edging is formed from soft vinyl for example, the joint where the butted ends meet and melt properly together will be stronger than any other location along the length of the edging. Since the edging is continuous and flexible it may be slipped around a board of many shapes; i.e., round cornered, or irregular in shape, and the inherent resiliency of the edging material will cause it to snugly engage the board edge at all locations. Further, the edging preferably has a pair of flanges which extend from the extreme edge of the edging inwardly along the working and rear surfaces of the board a short distance. Since these flanges define a width, in a relaxed condition, which is slightly less than the thickness of the board, they are resiliently expanded to fit around the board and hence a gripping effect is provided by the tendency of the material, which has a plastic memory, to return to its as-formed shape. In addition, the material from which the edging is formed has a relatively high co-efficient of friction so that a further force which resists separation of the edging from the board is present at all times, and without regard to whether there is a discontinuity in the edging at one or more points. In other words, the edging is self-adhering to the edge portion of the board at all locations.

The outer, exposed surface of the edging is formed with a pocket, the pocket being formed from a pair of flanges which extend from the body of the edging material, the flanges projecting slightly outwardly away from the body of the edging and then extend inwardly toward one another.

Any one of a number of rigid, yet flexible connectors are then hooked into the pocket formed by the flanges, the connector having any one of an almost infinite variety of shapes to perform desired tasks. The most usual configuration will be a slightly closed, but generally U-shape trough of a size to receive and flexibly grip a marker so that the board user can quickly and easily remove a marker from the holder for use on the board and, thereafter, insert the marker back into the holder after use. The connector may also be shaped as a tray to hold an eraser for the board, or as a connector for securing the board to a vertical surface or from the top edge of a wall.

BRIEF DESCRIPTION OF THE DRAWING

The invention is illustrated more or less diagrammatically in the accompanying drawing wherein:

FIG. 1 is a front elevation of the board edging system of this invention showing particularly the combination of a board and a marker;

FIG. 2 is a side view of the board edging system of FIG. 1;

FIG. 3 is a cross section, to an enlarged scale, of the resilient edging of FIGS. 1 and 2 in an as-formed condition;

FIG. 4 is a view taken substantially along the line 4—4 of FIG. 1 with the marker indicated in phantom for purposes of clarity;

FIG. 5 is a view similar to FIG. 4 showing the mode of connecting the connector, or clip, to the edging band;

DESCRIPTION OF THE INVENTION

Figure 6:
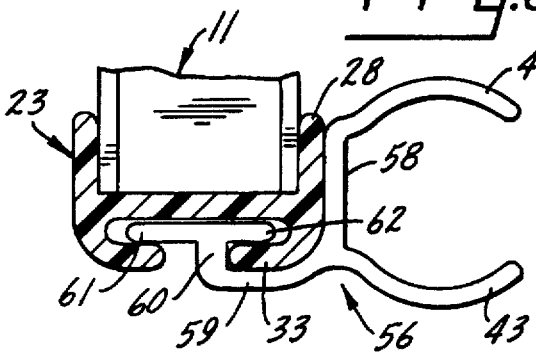
FIG. 6 is a view of another embodiment of the clip in which the object to be gripped projects transversely from the central plane of the board as would be most convenient when the marker is to be associated with the bottom of a board.

In the following description of the invention, like reference numerals will be used to refer to like or similar parts from Figure to Figure of the drawing.

Referring first to FIGS. 1–5, a dry erase board is indicated generally at 10, the board 10 including the board edging system of this invention. The board 10 further includes a writing board, indicated generally at 11, the writing board consisting of a front member, indicated generally at 12, an internal support structure, indicated generally at 13, and a backing indicated generally at 14. The front member 12 is preferably comprised of a thin, hard plastic capable of receiving and retaining, on its front or writing surface 15, marks made by a conventional marker. The internal support member 13 may be of any suitable construction, its primary purpose being to provide a support for the front member 12 of sufficient structural integrity to provide, in effect, a non-deformable foundation for front member 12. In this instance, a honeycomb construction has been shown but it will be understood that other suitable structures which perform the required function may be used. The backing 14 is here shown as a layer of kraft paper whose primary purposes are (a) to protect the internal support member, which may have less strength in a side direction, indicated at 16, then in a transverse direction, and (b) provide structural integrity to the three layers. It will be noted that in this instance the exposed edge 18 of front member 12, the exposed edge 19 of internal support member 13, and the exposed edge 20 of backer 14 lie in the same plane.

A board edging system, hereafter sometimes simply referred to as the "edging system", is indicated generally at 22 in FIG. 1. The edging system includes a continuous band of a deformable material indicated generally at 23 which surrounds the edge portion of the writing board 11. Band 23 has ends which are butted to one another as indicated at 24. The butted ends are melted together prior to assembly to the writing board 11 to form a joint which is stronger than the strength of any individual location along the length of the band 23. Further, the band 23, in an as-formed, disassembled condition has an internal periphery, as indicated at 25 in FIG. 3, which is slightly smaller than the circumference of the exposed edges, as formed by the layer edges 18, 19, and 20. As a consequence, the band 23 must be stretched slightly to be assembled to the writing board 11 as indicated in FIGS. 1, 2, and 4.

Band 23 includes a body section, indicated at 26, and two flanges, 27, 28, which extend in an inward direction from the body section 26, using "inwardly" in reference to a direction looking toward the center of the writing board 11. In the as-formed condition of FIG. 3, the internal flanges 27, 28, in their normal, non-assembled condition are inclined toward another and hence, when the band 23 is assembled to writing board 11, the internal flanges 27, 28, are forced apart to the parallel position of FIG. 4. As a result, the internal flanges 27, 28, press against the outer edge portion 29 of front writing surface 15 and the outer edge portion 30 of backer 14 so that a frictional gripping force is created which resists separation of band 23 from writing board 11. A pair of external flanges are indicated at 32, 33, extending outwardly from body section 26. As clearly seen in FIGS. 3 and 4, the external flanges 32, 33, project outwardly initially from body section 26 and then are directed inwardly toward one another, leaving a gap 34 between the ends 35, 36 of flanges 32, 33 respectively.

The band edging system further includes means 38 for supporting a board accessory from the dry erase board 10. The support means illustrated in FIGS. 1–5 is a clip, indicated generally at 39, which easily receives and relinquishes a dry erase board marker 40. The clip 39 includes a base member 41 which, as best seen in FIG. 4, is of a length to span the gap 34 of the band 23 and, in addition, overlap the gap 34 at each side thereof so that the external flanges 32, 33 form a base against which the base member 41 abuts. The base member 41 together with integral prongs 42, 43, form a slightly curled, generally U-shaped receptor for marker 40. It will be understood that the clip 39 is preferably formed from a hard plastic material which, in the thin section shown in FIGS. 1–5, is flexible. Since the distance 45 between the ends 46, 47, of the clip in an as-formed, non-operational relaxed condition, see FIG. 5, is less than the distance 48 between said ends 46, 47, in an operational, stretched condition, see FIG. 4, the prongs 42, 43, will exert a gripping force on marker 40 which retains the marker stationery with respect to writing board 11 in FIGS. 1 and 2, yet which easily releases the marker under hand pressure from a user.

A pair of engagement members are indicated at 50, 51, projecting inwardly from base member 41. The ends 52, 53 of the engagement members are feet 50, 51, extend outwardly as best seen in FIGS. 4 and 5, and are of a thickness which makes a snug fit in the space formed between body section 26 and flanges 32 and 33. As can be best seen in FIG. 5, flange 32 is sufficiently flexible to be easily bent back by a finger of a user to enable end 52 of the engagement member to clear the tip of flange 32 and move into the pocket formed between body section 26 and flanges 32, 33.

Referring now to FIG. 6 the clip there shown, indicated generally at 56, is formed to hold a marker off-line with respect to the central plane of the writing board 11. This suspension will be particularly appropriate when it is desired to hold a marker at the top or bottom of a writing board since this arrangement provides more convenient hand access for the user.

In this instance, the base member 58, from which prongs 42, 43, extend is longer than the base member 41 of the FIG. 4 embodiment, and includes an arm 59 which terminates in a single short section 60 from which long foot 61 and short foot 62 extend. Preferably, the clip 56 is so contoured that the base member 58 and arm 59 make abutting engagement with the internal flange 28 and external flange 33 of band 23.

Figure 7:
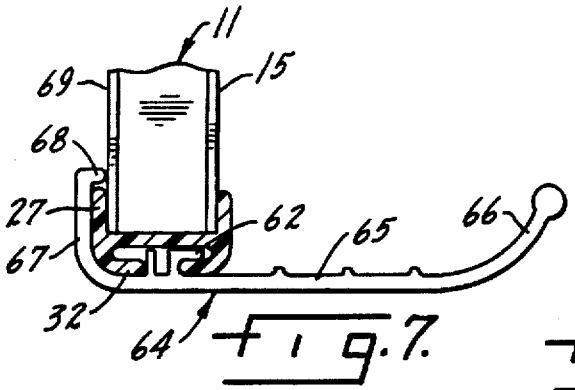
FIG. 7 is a view of another embodiment of a clip, the working edge of which is formed as a tray.

In FIG. 7 the clip 64 includes an elongated section 65 which terminates in an upturned end portion 66, the length of section 65 being sufficient to receive and hold an eraser to be used with the writing board 11. The opposite end 67 of clip 64 extends around, and conforms to, the exposed surface of internal flange 27 and external flange 32, and terminates in a spacer 68 which bears against the outside surface 69 of backer 14. It will be noted that spacer 68 is snugly received over internal flange 27 so that the tip of flange 27 forms an abutment which blocks downward movement of spacer 68 in a disengaging direction.

Figure 8:
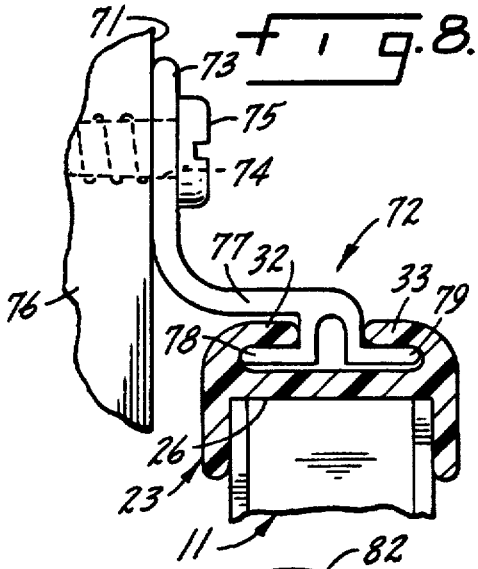
FIG. 8 is a view of another embodiment of the invention in which the clip forms part of means for mounting the board from its upper edge to a vertical surface.

FIG. 8 illustrates means for suspending a writing board 11 by its top from a vertical surface 71. The clip, indicated generally at 72, includes an upwardly extending arm 73 which has an aperture 74 which receives a fastener, such as screw 75, for securing the arm 73, and thereby the clip and writing board 11, to wall 76. Arm 73 terminates in a downwardly and outwardly extending section 77 which in turn terminates in feet 78, 79, which are received in the space formed between external flanges 32, 33, and body member 26 of band 23.

Figure 9:
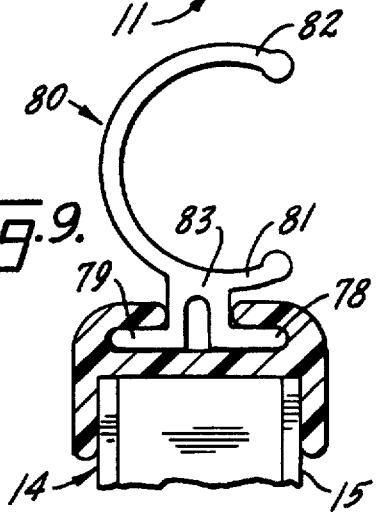
FIG. 9 is a view of another embodiment in which the clip presents an associated marker in a position to be insertable and removable in a direction transverse to the central plane of the board.

FIG. 9 illustrates an arrangement whereby the prongs 81, 82, of clip 80 are oriented in a direction 90° displaced with respect to the construction of FIG. 4. A portion 83 of prong 81 forms, in effect, a base member for securing the generally U-shaped receptacle to the feet 78, 79. In this construction, a user presses a marker into the receptacle portion of the clip in a direction perpendicular to the plane of writing surface 15.

Figure 10:
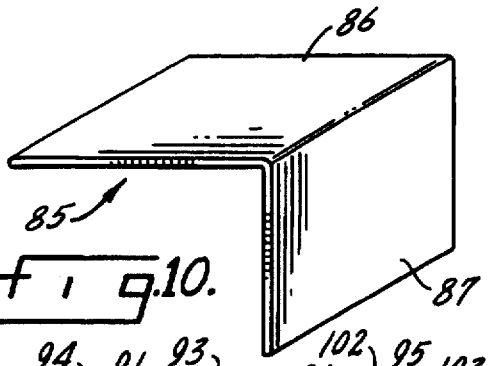
FIG. 10 is a perspective view of a component of a system for mounting the board from the upper edge of a vertical wall.
Figure 11:
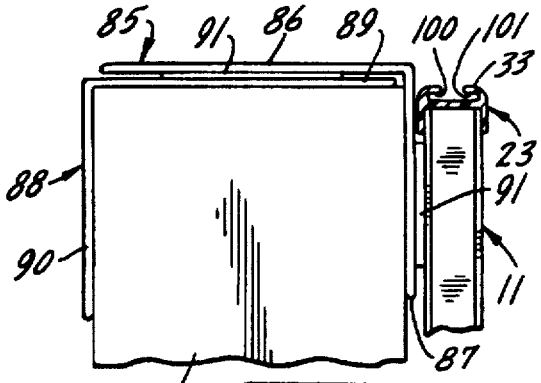
FIG. 11 is a side view of system for mounting the board from the upper edge of a vertical wall.

FIGS. 10 and 11 illustrate an embodiment of the invention in which the writing board 11 may have a band 23 with its consequent advantages as described above, but in which supplemental means may be used to support the board 11 from a wall 84. An L-shaped connector is indicated generally at 85 in FIG. 10, the connector having two legs 86, 87. Preferably leg 86 is longer so that when two connectors 85 are placed on top of one another they are adjustable to the thickness of the partition wall from which the connector is suspended.

In FIG. 11, two identical connectors, 85 and 88, the latter having legs 89, 90, are shown with leg 86 of connector 85 and leg 89 of connector 88 in overlapped, adhered, butting engagement. Leg 87 of connector 85 is secured to mounting board 10 by connecting means 91, such as glue, adhesive, velcro, etc. The inside surfaces of legs 89, 90 of connector 88, and the inside surface of leg 87 of connector 85 are in turn secured to wall 84 by any suitable means, such as an adhesive or a mechanical fastener. It will be understood that, given the illustrated width of wall 84, only one connector, in this instance connector 85 would be required to suspend board 11 from the upper edge of partition wall 84. However, the showing of two connectors, 85 and 88, in FIG. 11 illustrates the fact that by using two connectors, board 11 can be supported from a partition wall much thicker than the illustrated wall 84 by merely sliding legs 86 and 89 horizontally with respect to one another.

Figure 12:
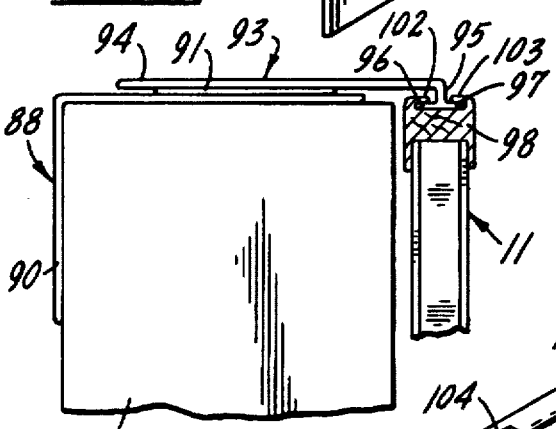
FIG. 12 is a view of another embodiment of the clip component of the system for mounting the board from the upper edge of a vertical wall.

FIG. 12 illustrates a rigid frame embodiment of the invention in that the connector, indicated generally at 93, includes a long arm 94 which terminates in a very short arm 95 from which locking feet 96, 97 project. In this embodiment the band 98 which surrounds the writing board 11 is formed from wood or plastic or other rigid material. Locking feet 96, 97 are received in the space defined by the flanges 102, 103 and the body of band 98. The limiting factor will likely be the weight of the board, since, with this construction, the upper surface of locking feet 96, 97 will press upwardly against the undersides 100, 101, (see FIG. 11 for clarity) of the flanges 102, 103 of band 98 in a separating direction. If desired, connector 88 could be dispensed with.

Figure 13:
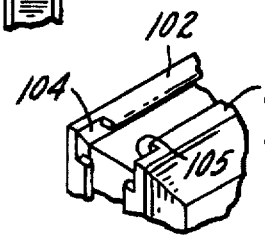
FIG. 13 is a partial perspective view of a component of the embodiment of FIG. 12.

Since band 98 is rigid, the connector 93 cannot be assembled to the band at any location along the periphery as illustrated in FIG. 5. Rather, the connector 93 must be slid into assembly with the band 98 and this expedient is illustrated in FIG. 13. As seen there, the end portion of flanges 102, 103 are cut away as indicated at 104 and 105, respectively, to provide a passage for the sliding assembly of a connector 93 to the band 98 at one or more junctions.

From the above description, it will be appreciated that the board edging system and a method of manufacture thereof which is common to all embodiments overcomes the disadvantages of the prior art and achieves the objectives set forth hereinbefore. It will be appreciated however, that changes and modifications may be made within the scope of the invention without departing from the spirit of the invention. Accordingly, it is intended that the scope of the invention be limited solely by the scope of the hereafter appended claims when interpreted in light of the relevant prior art, and not by reference solely to the foregoing description.

I claim:

1. A board edging system for a board of a given size, said system including a board, a continuous, integral band surrounding the periphery of said board;

said band having a length in an as-formed condition which is less than the periphery of the board;

said band being formed from a soft flexible material having the characteristics with respect to compressibility, resiliency and plastic memory of rubber, vinyl or plastic; and means formed in said band for attaching an accessory to said band, said accessory being adapted for use with said board.

2. The board edging system of claim 1 further characterized in that said attaching means includes two extensions which extend outwardly from said band and then inwardly toward one another;

said extension forming a gap suitable for receiving an accessory retainer therebetween said retainer having a connecting portion; and said extensions projecting outwardly from the band so as to form a space between the exterior of the band and the interior of the extensions sufficient to receive and retain the connecting portion of the retainer.

3. The board edging system of claim 2 further characterized by and including:

a pair of flanges, one on each side of the band, extending inward toward the center of the board around the periphery thereof, each flange having an inner extremity; and the distance between the extremities of the flanges in an as-formed condition being less than the thickness of the board, whereby the flanges are biased away from one another when the band is assembled to the board and exert a gripping force on the board.

4. The board edging system of claim 1 further including:

a retainer for a board accessory, said retainer being coupled to said attaching means.

5. The board edging system of claim 4 further characterized in that the retainer is a generally U-shaped clip capable of receiving, and resiliently holding, a marker.

6. The board edging system of claim 5 further characterized in that the clip has an axis which lies in the plane of the board.

7. The board edging system of claim 5 further characterized in that the the clip has an axis which lies in a plane which is parallel to the plane of the board.

8. The board edging system of claim 4 further characterized in that the retainer is an eraser tray.

9. The board edging system of claim 4 further characterized in that the retainer includes means for fastening the board to a vertical surface.

10. The board edging system of claim 3 further including means for suspending the board from the upper edge of a wall.

11. The board edging system of claim 10 further characterized in that the means for suspending the board from the upper edge of a wall includes two L-shaped members adapted to be connected to a wall and the board.

12. The board edging system of claim 10 further characterized in that:

the means for suspending the board from the upper edge of a wall includes an L-shaped member.

13. A method of manufacturing a band and accessory retainer for a board edging system and assembling said band to a board, said method including the steps of:

forming a band from a strip of soft, flexible material having the characteristics with respect to compressibility, resiliency and plastic memory of rubber, vinyl or plastic;

said strip having a length less than the periphery of the board to which the band is to be assembled;

melting the ends of the discrete length of the band to one another to form a joint which is stronger than any other location along the run of said band;

stretching the band to a length greater than the periphery of the board;

thereafter placing the band around the periphery of the board; and means formed in the band including means for attaching an accessory to the band, the accessory being adapted to use with the board.

* * * * *